United States Patent [19]
Sasaki et al.
[11] Patent Number: 4,463,086
[45] Date of Patent: Jul. 31, 1984

[54] LIGHT-SENSITIVE SILVER HALIDE COLOR PHOTOGRAPHIC MATERIAL

[75] Inventors: Takashi Sasaki; Yutaka Kaneko; Fumio Ishii; Yasuo Tsuda; Kazuhiko Kimura; Katsunori Kato, all of Hino, Japan

[73] Assignee: Konishiroku Photo Industry Co., Ltd., Tokyo, Japan

[21] Appl. No.: 520,556

[22] Filed: Aug. 5, 1983

[30] Foreign Application Priority Data

| | | | |
|---|---|---|---|
| Aug. 17, 1982 | [JP] | Japan | 57-142839 |
| Aug. 17, 1982 | [JP] | Japan | 57-142840 |
| Aug. 26, 1982 | [JP] | Japan | 57-149792 |

[51] Int. Cl.[3] ..... G03C 7/26
[52] U.S. Cl. ..... 430/553; 430/505; 430/554
[58] Field of Search ..... 430/553, 505, 554

[56] References Cited

U.S. PATENT DOCUMENTS

| | | | |
|---|---|---|---|
| 3,758,308 | 9/1973 | Beavers et al. | 430/553 |
| 3,880,661 | 4/1975 | Lau et al. | 430/553 |
| 4,009,035 | 2/1977 | Kojima et al. | 430/553 |

*Primary Examiner*—J. Travis Brown
*Attorney, Agent, or Firm*—Frishauf, Holtz, Goodman & Woodward

[57] ABSTRACT

There are disclosed a light-sensitive silver halide color photographic material having a light-sensitive silver halide emulsion layer containing at least one kind of cyan dye forming couplers represented by the formula [I] or the formula [II] as defined in the specification provided on a reflective support, and a light-sensitive silver halide color photographic material further having a green-sensitive silver halide emulsion layer containing at least one kind of magenta couplers represented by the formula [III] as defined in the specification.

The light-sensitive silver halide color photographic materials according to this invention have excellent color forming characteristics and form very fast dyes to heat, light and humidity.

18 Claims, No Drawings

LIGHT-SENSITIVE SILVER HALIDE COLOR PHOTOGRAPHIC MATERIAL

This invention relates to a light-sensitive silver halide color photographic material (hereinafter called merely as "sensitive material") which is suitable particularly as a sensitive material for print, more particularly to a sensitive material containing a novel cyan dye image forming coupler.

Color photographic images by a silver halide are obtained following the process in which an aromatic primary amine type color developing agent is itself oxidized when reducing the exposed silver halide grains, and the three different couplers capable of forming dyes through the reactions with the oxidized product undergo respective reactions in a silver halide emulsion thereby to form dye images.

In the above process, color reproduction is effected through the subtractive method, and the three colors of yellow, magenta and cyan are employed. Among them, couplers widely used for formation of cyan dyes are phenols and naphthols. In particular, the points to be improved desirably in phenol cyan couplers are firstly that the cyan dye formed should have good spectral absorption characteristics, namely with small absorptions in the green region of the absorption spectrum (particularly 500 nm–550 nm) and the maximum absorption wavelength being on the longer wavelength side (640 nm–660 nm); secondly that the cyan dye formed should have sufficient fastness to light, heat and humidity and without contamination at the undeveloped portion under such storage conditions; thirdly that the coupler should have good color developing characteristics, namely having sufficient color forming sensitivity and color forming density; and fourthly that there should be no loss of the dye even when a bleaching solution or a bleach-fixing solution comprising a EDTA ferric salt as the main component is fatigues after running.

And, a large number of techniques have been disclosed for improving these drawbacks. In particular, as the coupler to the fore of interest on account of excellent characteristics with respect to the above fourth point, there is 2,5-diacylaminophenol coupler. For example, it is a coupler having acylamino groups at the 2- and 5-positions on phenol, as disclosed in U.S. Pat. Nos. 2,772,162 and 2,895,826. These couplers are certainely excellent in heat resistance of cyan dyes and also excellent in spectral absorption characteristics. However, they involve the vital defect that they are markedly inferior in color forming characteristics of the couplers per se and light resistance of the dyes. For improvement of such defects, a coupler having introduced a fluorine atom at the 4-position on phenol nucleus was disclosed in, for example, U.S. Pat. No. 3,758,308. These couplers, while exhibiting excellent color forming performance, have undesirable property that yellow contamination is formed by light.

There are also disclosed 2,5-diacylaminophenol couplers having a pentafluorobenzamide group at the 2-position on phenol nucleus in U.S. Pat. Nos. 3,758,308 and 3,880,661. The couplers described in these publications are satisfactory with respect to spectral absorption characteristics, but they are not necessarily sufficient with respect to fastness of dyes.

Also disclosed are 2,5-diacylaminophenol cyan couplers having a sulfonamide group at the 5-position on phenol nucleus, as described in Japanese Provisional Patent Publications Nos. 109630/1978, 163537/1980, 29235/1981, 99341/1981, 116030/1981, 55945/1981 and 80054/1981. The dyes with the use of these couplers are excellent in fastness, but insufficient with respect to spectral absorption characteristics.

Thus, no cyan coupler of the prior art is realized to satisfy all of the conditions, and it is strongly desired in recent years to have a cyan coupler which can satisfy these various characteristics.

On the other hand, so far as magenta couplers are concerned, there have widely been used 1,2-pyrazolo-5-ones, and the great problem involved is that the magenta dyes formed by this coupler has a side absorption region at 450–480 nm, in addition to the main absorption region at 550 nm. Accordingly, a large number of researches have been made for improving this drawback. For example, 1,2-pyrazolo-5-ones having an anilino group at the 3-position on pyrazolone nucleus are useful particularly for obtaining print color images, on account of small side absorption as mentioned above. These techniques are disclosed in, for example, U.S. Pat. No. 2,343,703 and U.K. Pat. No. 1,059,994. However, the magenta dyes obtained by these techniques have the drawback in image storability, particularly inferior in light resistance.

This invention has been accomplished in view of the state of the art as described above, and its object is to provide a light-sensitive silver halide color photographic material containing a cyan coupler, which is (i) small in absorption at the green region in absorption spectrum, with the maximum absorption wavelength being at the longer wavelength side at 640–660 nm,
(ii) capable of forming a cyan dye having sufficient fastness to heat, light and humidity,
(iii) excellent in color forming characteristics, and also free from loss of dyes even when a bleaching or bleach-fixing bath may be fatigued after running.

Another object of this invention is to provide a light-sensitive silver halide color photographic material containing a coupler, capable of forming cyan dye and magenta dye which are excellent in spectral absorption characteristics and also in image storage characteristics.

The present inventors have made various investigations and found that the above objects can be accomplished by a light-sensitive silver halide color photographic material, having a light-sensitive silver halide emulsion layer containing at least one kind of cyan dye forming couplers represented by the formula [I] or the formula [II] as shown below provided on a reflective support:

Formula [I]

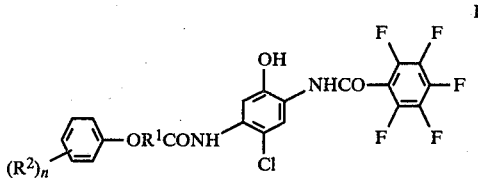

wherein $R^1$ represents a straight or branched alkylene group having 1 to 8 carbon atoms; $R^2$ represents an alkyl group; and n represents an integer of 1 to 3; $R^2$ may be the same or different when n is 2 or more, Formula [II]

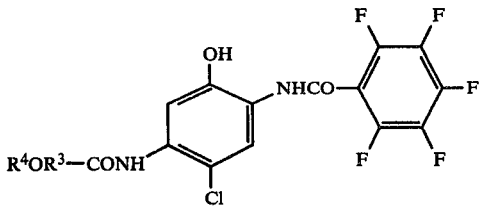

wherein $R^3$ represents a straight or branched alkylene group; and $R^4$ represents a phenyl group having an alkylsulfamoyl group, an arylsulfamoyl group, an alkylsulfonamide group, an arylsulfonamide group or an aminosulfonamide group.

Also, in accordance with this invention, the above objects can also be accomplished by a light-sensitive silver halide color photographic material further having, in addition to the layer containing a cyan dye forming coupler represented by the above formula [I] or [II], a green-sensitive silver halide emulsion layer containing at least one kind of magenta couplers represented by the formula [III] as shown below:

Formula [III]

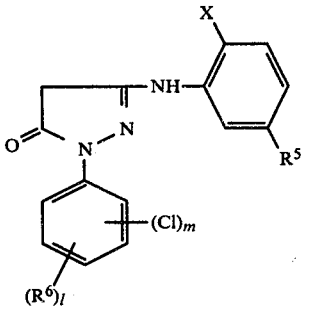

wherein $R^5$ represents a group

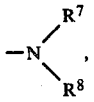

wherein $R^7$ and $R^8$ each represent a hydrogen atom, an alkyl group, an acyl group, an alkylsulfonyl group or an arylsulfonyl group, or $R^7$ and $R^8$ taken together may form a 5-membered heterocyclic ring together with nitrogen atom, a sulfamoyl group, a carbamoyl group, a ureido group or a carboxylic acid ester group; $R^6$ represents a methoxy group or a methyl group; X represents a halogen atom or an alkoxy group having 1 to 5 carbon atoms; l represents an integer of 0 to 2; and m represents an integer of 1 to 3.

In the following, this invention is to be described in detail.

In the cyan coupler of this invention represented by the above formula [I], $R^1$ has 1 to 8 carbon atoms, which may be either straight chain or branched, particularly preferably 1 to 7 carbon atoms. And, $R^1$ may preferably be represented by

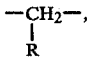

in which R is particularly preferred to have 3 to 6 carbon atoms. Preferable examples of such an alkylene group may include methylene group, 1,1-ethylene group, 1,2-ethylene group, 2,2-propylene group, 1,3-propylene group, 1,1-isobutylene group, 1,1-pentylene group, 3-methyl-1,1-butylene group, 1,1-heptylene group and the like.

On the other hand, the alkyl group represented by $R^2$ may have 1 to 20 carbon atoms, as exemplified by methyl group, ethyl group, i-propyl group, butyl group, t-butyl group, pentyl group, sec-pentyl group, t-pentyl group, t-octyl group, nonyl group, dodecyl group, sec-dodecyl group, octadecyl group, etc.

And, $R^2$ may be bonded to the benzene ring in number of 2 to 3, and when two or more of these groups are bonded, they may be the same or different.

However, it is preferred that the total carbon atoms of a plural number of $R^2$ groups should be 8 to 18.

And, when $R^1$ and $R^2$ are other groups than those specified above or when the split-off group is other than chlorine atom, no desired effect of this invention can be realized.

In the above formula [II], $R^3$ represents a branched or straight alkylene group. In this case, the alkylene group may preferably have 1 to 20 carbon atoms. Preferable examples of this alkylene group may include methylene group, 1,1-ethylene group, 1,2-ethylene group, 2,2-propylene group, 1,3-propylene group, 1,1-isobutylene group, 1,1-pentylene group, 3-methyl-1,1-butylene group, 1,1-heptylene group, 1,1-nonylene group, 1,1-dodecylene group, 1,1-tridecylene group and the like.

On the other hand, $R^4$ represents a phenyl group substituted with at least one of alkylsulfamoyl groups, arylsulfamoyl groups, alkylsulfonamide groups, arylsulfonamide groups or aminosulfonamide groups.

In the magenta coupler represented by the formula [III], preferable is a compound having the following formula [III']:

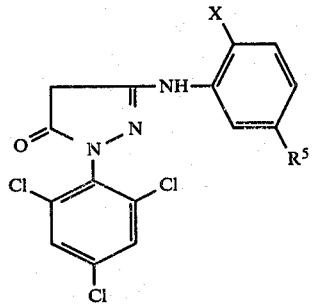

wherein $R^5$ and X have the same meanings as defined above.

Next, the couplers which can be represented by the formulas [I] to [III] are enumerated as typical exemplary compounds, respectively, by which this invention is not limited.

Exemplary Compounds
[I - 1]
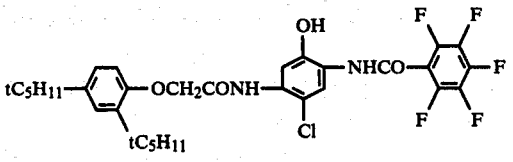
[I - 2]
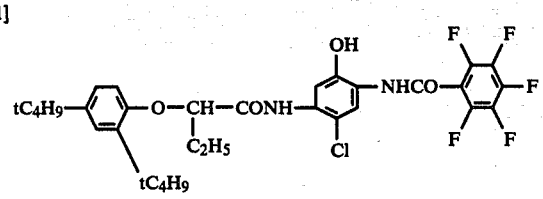
[I - 3]
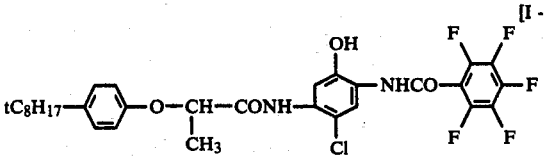
[I - 4]
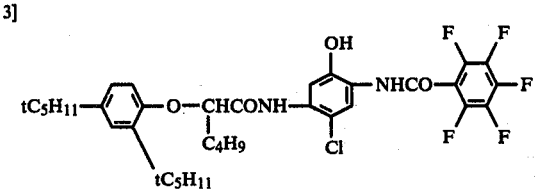
[I - 5]
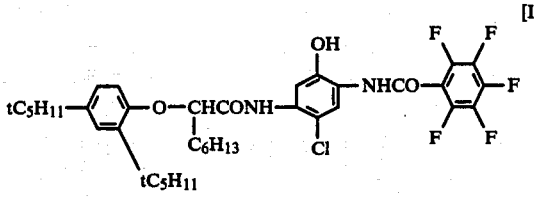
[I - 6]
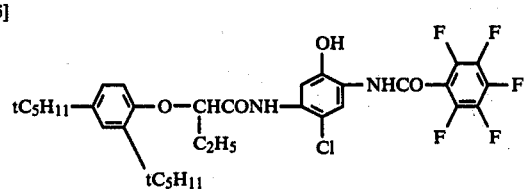
[I - 7]
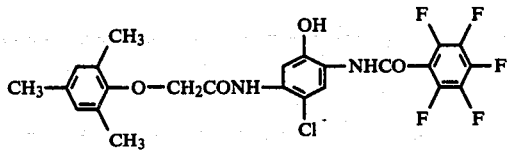
[I - 8]
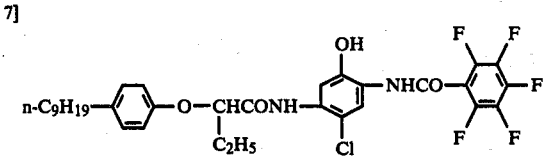
[I - 9]
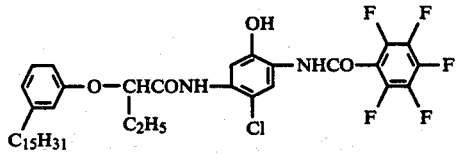
[I - 10]
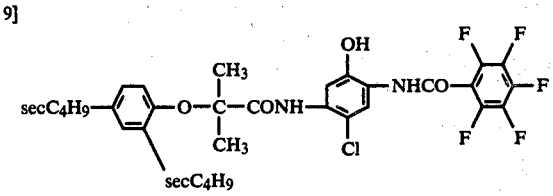
[I - 11]
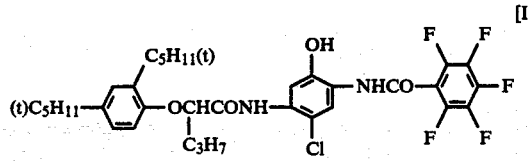
[I - 12]
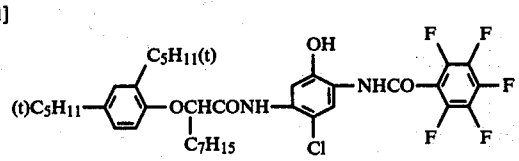
[I - 13]
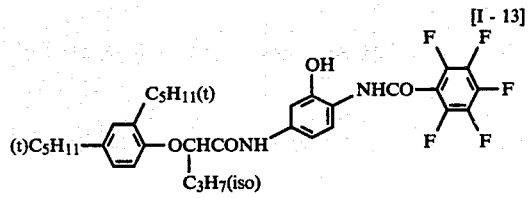
[II - 1]
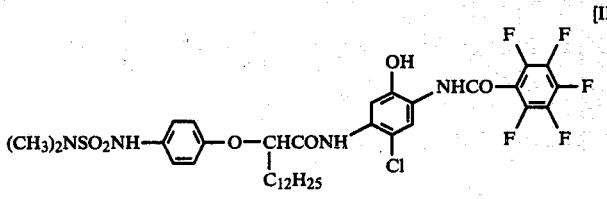
[II - 2]
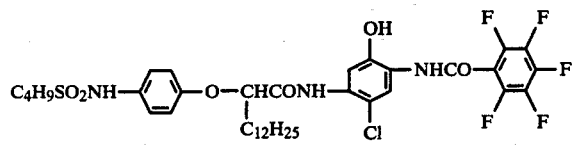
[II - 3]
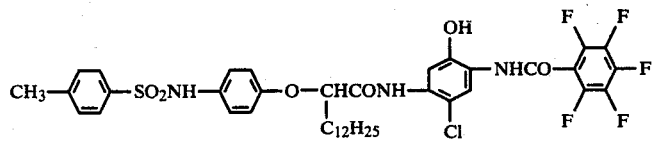

-continued
Exemplary Compounds
[II - 4]
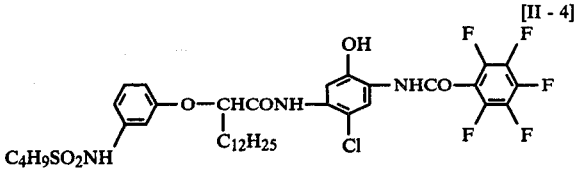
[II - 5]
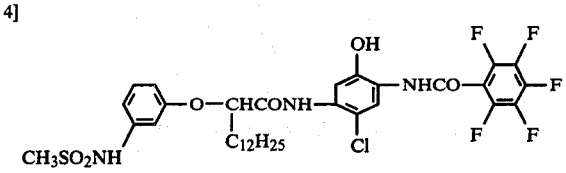
[II - 6]
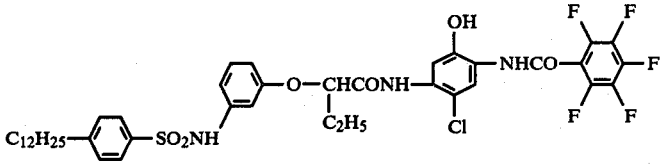
[II - 7]
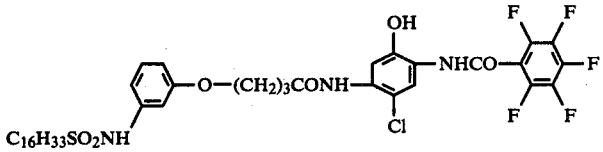
[II - 8]
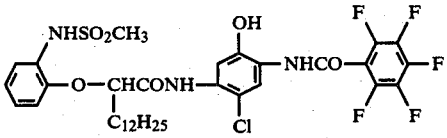
[II - 9]
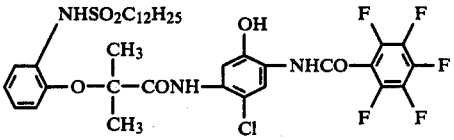
[II - 10]
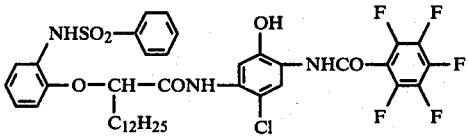
[II - 11]
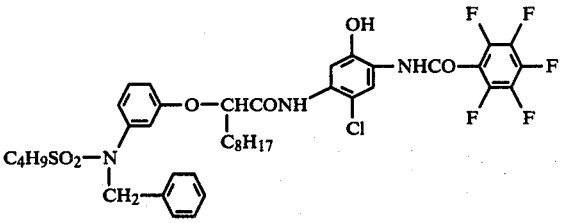
[II - 12]
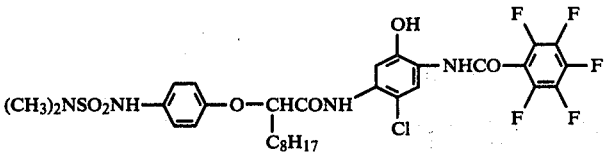
[II - 13]
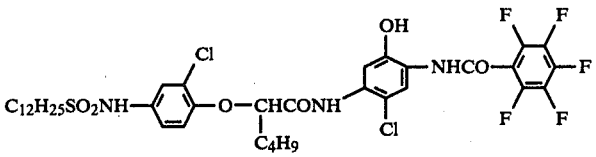
[II - 14]
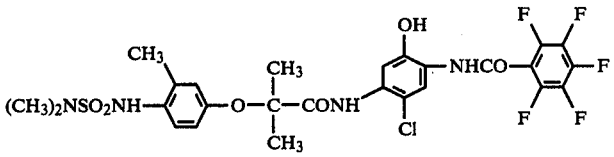
[II - 15]
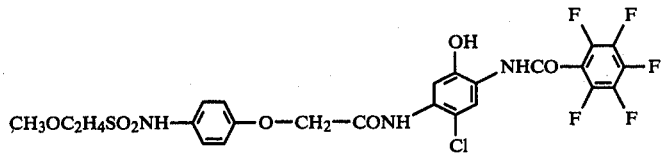

-continued
Exemplary Compounds
[II - 16]
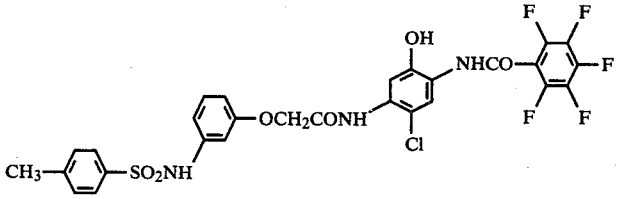
[II - 17]
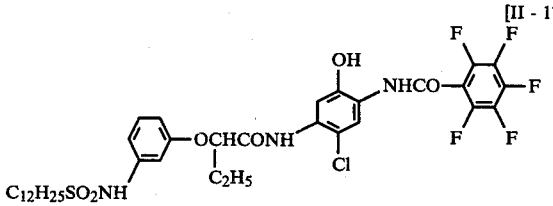
[II - 18]
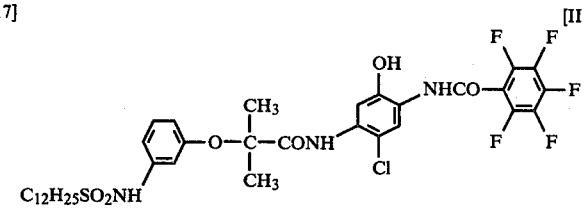
[II - 19]
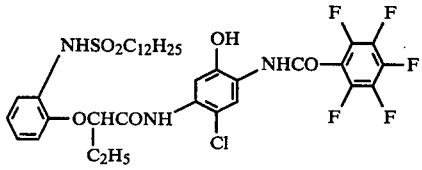
[II - 20]
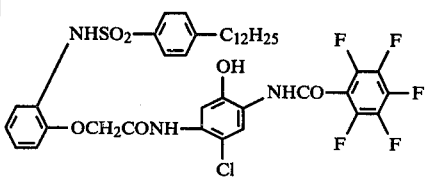
[II - 21]
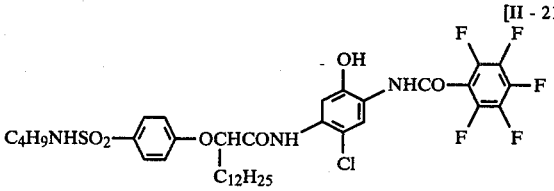
[II - 22]
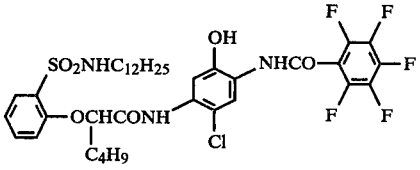
[II - 23]
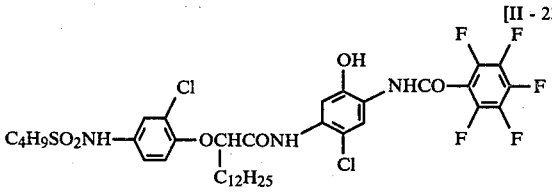
[II - 24]
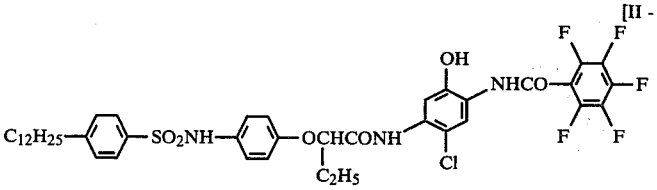
[III - 1]
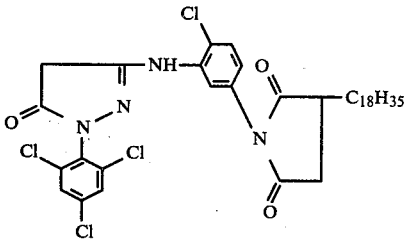
[III - 2]
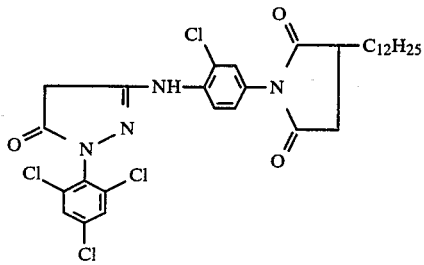
[III - 3]
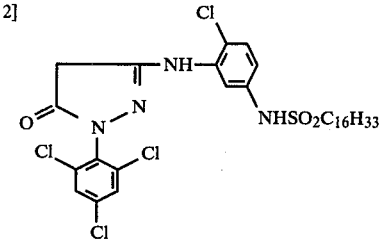

-continued
Exemplary Compounds
[III - 4]
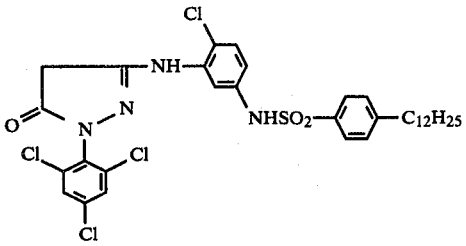
[III - 5]
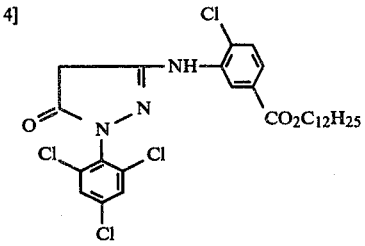
[III - 6]
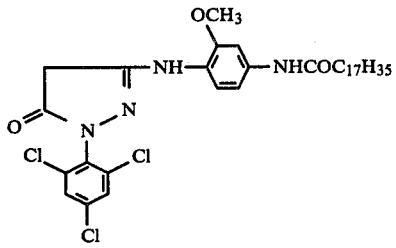
[III - 7]
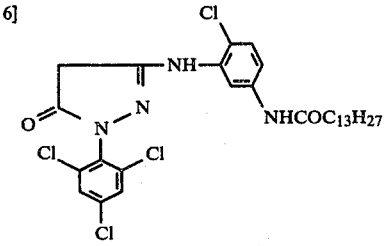
[III - 8]
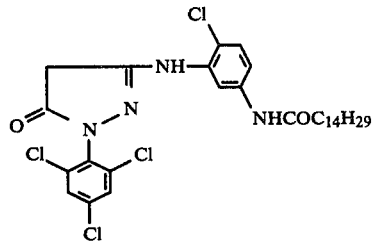
[III - 9]
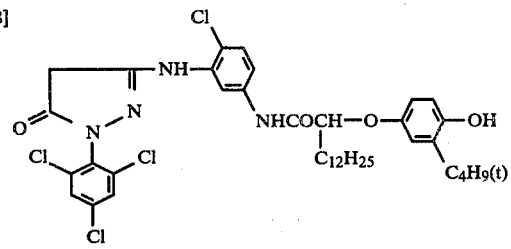
[III - 10]
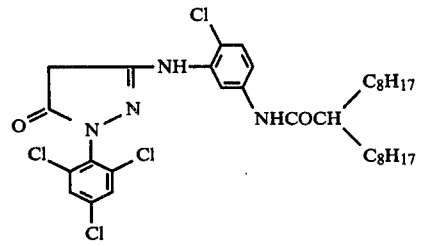
[III - 11]
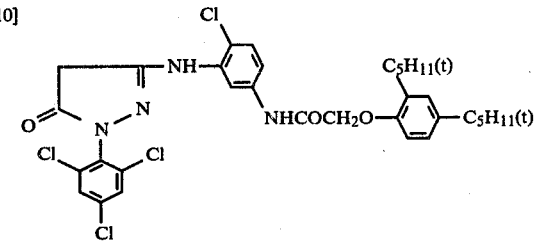
[III - 12]
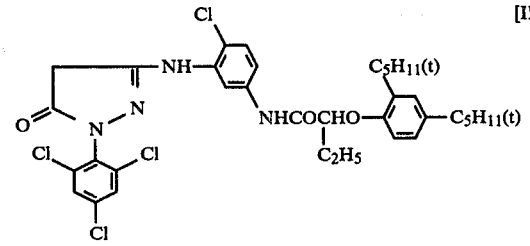
[III - 13]
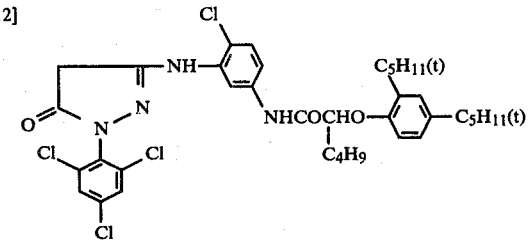
[III - 14]
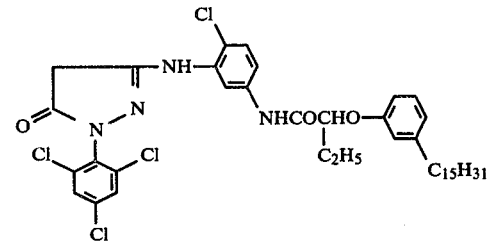
[III - 15]
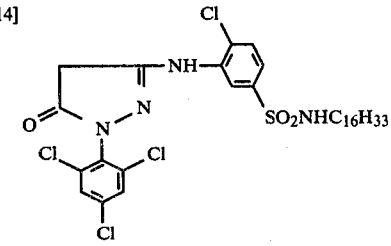

-continued

Exemplary Compounds

[III - 16]

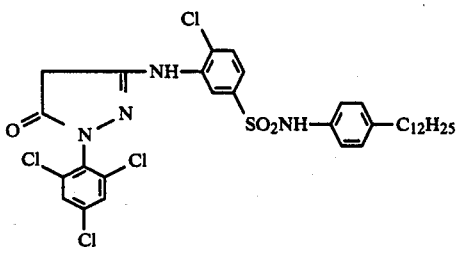

[III - 17]

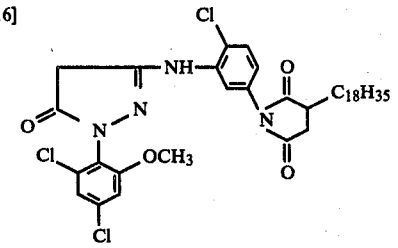

[III - 18]

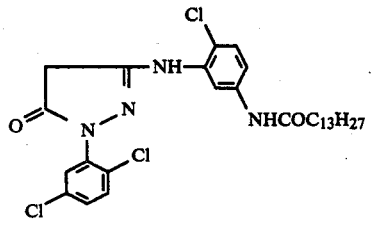

[III - 19]

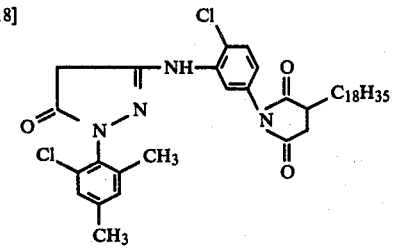

[III - 20]

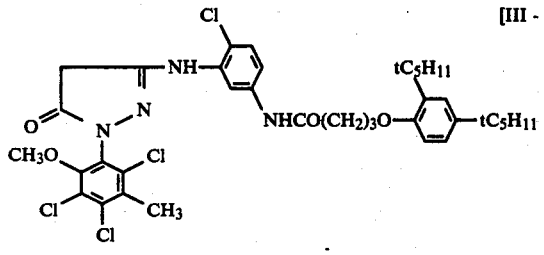

The compounds of the formula [I] or [II] can be synthesized generally according to the following reaction schemes:

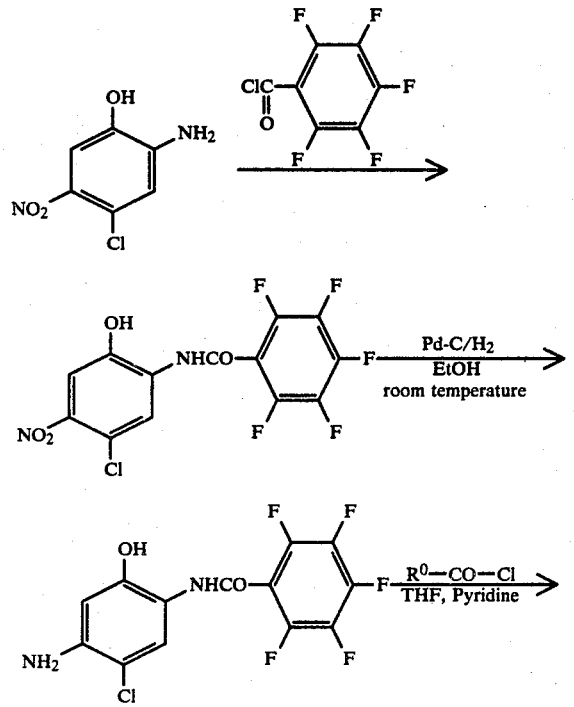

-continued

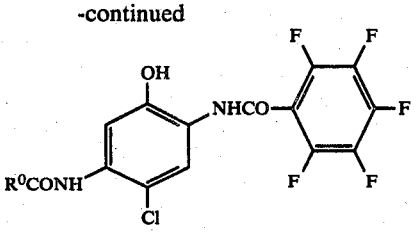

wherein $R^0$ is

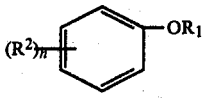

or $R^4$—O—$R^3$— as described above.

In the following, Synthesis examples of specific compounds are shown.

SYNTHESIS EXAMPLE 1

Coupler No. [I-6]:

2-(2,3,4,5,6-pentafluorobenzamido)-4-chloro-5-{5-α-(2,4-di-tert-amylphenoxy)-n-butanamido}phenol (A) In 100 ml of acetonitrile was dispersed 18.9 g (0.10 mole) of 2-amino-4-chloro-5-nitrophenol and a solution of 23.1 g (0.10 mole) of 2,3,4,5,6-pentafluorobenzoyl chloride in 50 ml of acetone was added dropwide to the resultant dispersion. After heating under reflux for 3 hours, the reaction mixture was ice-cooled and the precipitated solids were collected by filtration, washed with cooled acetonitrile and dried to obtain 32.5 g of 2-(2,3,4,5,6-pentafluorobenzamido)-4-chloro-5-nitrophenol (Yield 85%).

(B) The above crude crystals in an amount of 16 g (0.042 mole) were dissolved in 500 ml of ethanol, followed by addition of a palladium-carbon catalyst, and catalytic reduction was conducted with hydrogen under normal pressure at normal temperature. Then, the palladium-carbon catalyst was filtered off and the filtrate was concentrated. The residue was dissolved in 200 ml of acetonitrile and recrystallized to give 11 g of 2-(2,3,4,5,6-pentafluorobenzdmido)-4-chloro-5-aminophenol (Yield 74%).

(C) While stirring at room temperature a mixture of 3.2 g (0.009 mole) of the above phenol derivative with 0.9 g of a solution of sodium acetate in 30 ml of acetic acid, a solution of 3.7 g of α-(2,4-di-tert-butylphenoxy)-n-butanoyl chloride in acetic acid (10 ml) was added dropwise thereto. After the reaction was carried out at room temperature for 30 minutes, the reaction mixture was poured into 300 ml of water and the solids were collected by filtration. Recrystallization from acetonitrile gave 3.5 g (Yield 60%) of the title coupler No. [I-6]. The structure of the title product was confirmed by mass spectrum, elemental analysis and NMR spectrum.

SYNTHESIS EXAMPLE 2

Coupler No. [I-4]:
2-(2,3,4,5,6-pentafluorobenzamido)-4-chloro-5-{α-(2,4-di-tert-amylphenoxy)-n-hexanamido)}phenol While stirring at room temperature a mixture of 4.5 g of the intermediate 2-(2,3,4,5,6-pentafluorobenzamido)-4-chloro-5-aminophenol in the above Synthesis example 1 with a solution of 25 g of sodium acetate in 80 ml of acetic acid, a solution of 5.7 g of α-(2,4-di-tert-amylphenoxy)-n-hexanoyl chloride in 20 ml acetic acid was added dropwise thereto. After the reaction was carried out at room temperature for 30 minutes, the reaction mixture was poured into 300 ml of water and the solids were collected by filtration. Recrystallization from acetonitrile gave 3.5 g (Yield 60%) of the title coupler No. [I-4] melting at 200° to 201° C.

SYNTHESIS EXAMPLE 3

Coupler No. [II-1]:
2-(2,3,4,5,6-pentafluorobenzamido)-4-chloro-5-{α-(4-dimethylaminosulfonylaminophenoxy)tetradecanamido}phenol (A) In 100 ml of acetonitrile was dispersed 18.9 g (0.10 mole) of 2-amino-4-chloro-5-nitrophenol and a solution of 23.1 g (0.10 mole) of 2,3,4,5,6-pentafluorobenzoyl chloride in 50 ml of acetone was added dropwide to the resultant dispersion. After heating under reflux for 3 hours, the reaction mixture was ice-cooled and the precipitated solids were collected by filtration, washed with cooled acetonitrile and dried to obtain 32.5 g of 2-(2,3,4,5,6-pentafluorobenzamido)-4-chloro-5-nitrophenol (Yield 85%).

(B) The above crude crystals in an amount of 16 g (0.042 mole) were dissolved in 500 ml of ethanol, followed by addition of a palladium-carbon catalyst, and catalytic reduction was conducted with hydogen under normal pressure at normal temperature. Then, the palladium-carbon catalyst was filtered off and the filtrate was concentrated. The residue was dissolved in 200 ml of acetonitrile and recrystallized to give 11 g of 2-(2,3,4,5,6-pentafluorobenzamido)-4-chloro-5-aminophenol (Yield 74%).

(C) To a solution of 10 g (0.028 mole) of the above phenol derivative and 13.8 g (0.030 mole) of α-(4-dimethylaminosulfonylaminophenoxy)tetradecanoyl chloride in 150 ml of tetrahydrofuran was added, slowly under ice-cooling, 4 g (0.050 mole) of pyridine. After the mixture was stirred at room temperature for 2 hours, the solvent was evaporated under reduced pressure. The residue was recrystallized from 200 ml of a 1:1 solvent mixture of n-hexane and ethyl acetate to give 12.4 g Yield 53%) of the title coupler No. [II-1], melting at 130° to 131° C. The confirmation of the structure of the title product was conducted by mass spectrum, elemental analysis and proton NMR spectrum.

SYNTHESIS EXAMPLE 4

Coupler No. [II-2]:
2-(2,3,4,5,6-pentafluorobenzamido)-4-chloro-5-{α-(4-butanesulfonylaminophenoxy)tetradecaneamido}phenol To a suspension of 10 g (0.028 mole) of the intermediate 2-(2,3,4,5,6-pentafluorobenzamido)-4-chloro-5-aminophenol in the above Synthesis example 3 and 14.2 g (0.030 mole) of α-(4-butanesulfonylaminophenoxy)-tetradecanoyl chloride suspended in 100 ml of acetic acid, there was added 3.3 g (0.040 mole) of sodium acetate. After stirring at room temperature for 3 hours, the reaction mixture was poured into 500 ml of water and the solids were separated by filtration. After the solids were dried, they were recrystallized from acetonitrile to obtain 14.2 g (Yield 60%) of the title product, melting at 127° to 131° C. The structure of the title product was confirmed by mass spectrum, elemental analysis and proton NMR spectrum.

Such couplers are generally lipophilic and, for incorporation of such a coupler in a light-sensitive material, at least one of the compounds represented by the formula [I] or [II] is dissolved as the so called oil protect in a high boiling organic solvent and contained in a silver halide emulsion layer (generally a red-sensitive emulsion layer or a layer adjacent thereto).

In this invention, when both of the above cyan coupler and magenta coupler according to this invention are to be used, both couplers may be used each in an amount of 10 to 30 mole %, preferably 15 to 25 mole %, per mole of silver.

And, according to this invention, as also apparently will be seen from the Examples, the effect of this invention can be accomplished only by the use or the specific combined use of the aforesaid couplers according to this invention.

That is, according to this invention, when a magenta coupler is used in combination, storage stability of the magenta color image is particularly improved, and excellent images can be obtained without damaging the color reproducibilities by both couplers.

Next, the light-sensitive silver halide color photographic material (hereinafter abbreviated as the sensitive material of the invention) is to be described in detail.

The couplers of this invention can be incorporated in the emulsion layer of the color sensitive material according to a conventional method. For example, the couplers of this invention may be dissolved singly or in combination in a solvent which may be either a high boiling organic solvent with a boiling point of 175° C.

or higher, such as tricresyl phosphate, dibutyl phthalate, etc. or a low boiling solvent such as butyl acetate, butyl propionate, etc. or, if desired, a mixture of such solvents; then the resultant solution is mixed with an aqueous gelatin solution and emulsified by means of a high speed rotary mixer or a colloid mill, followed by addition of a silver halide, to prepare a silver halide emulsion to be used in this invention. Also, those soluble in alkaline water may be added according to the Fischer dispersion method.

Thus, when the above couplers are incorporated in the light-sensitive layers of the sensitive materials, they have particularly good reactivities without exhibiting bad mutual interaction with color development and have the advantage to give improvement with respect to color contamination, etc. The dyes obtained by the use of the couplers of this invention also satisfy the excellent color absorbing characteristics as mentioned above.

The light-sensitive layer (silver halide emulsion layer) of the sensitive material containing a cyan coupler according to this invention is generally red-sensitive, and the silver halide to be used is inclusive of any silver halide conventionally used in silver halide emulsions such as silver bromide, silver chloride, silver iodobromide, silver chlorobromide, silver chloroiodobromide, etc. On the other hand, the emulsion to be used in the sensitive material containing a magenta coupler may be any of silver chloride, silver bromide, silver chlorobromide, silver iodobromide or silver iodobromochloride.

Said emulsion constituting the silver halide emulsion may be prepared according to any of the methods known in the art such as the acidic method, the neutral method or the ammonia method, or according to the single jet method or the double jet method. Alternatively, it is also possible to use the so-called controlled double jet method, if desired. This method is advantageous for obtaining a mono-dispersed type emulsion with very narrow particle size distribution. Further, the emulsion can also be prepared according to other methods, for example, the method disclosed in Japanese Patent Publication No. 7772/1971 or the method disclosed in U.S. Pat. No. 2,592,250, namely the method for preparation of the so called conversion emulsion, in which an emulsion of silver salt particles comprising at least in part a silver salt with greater solubility than silver bromide, and then at least a part of the particles is converted to silver bromide salt or silver iodobromide salt, or the method for preparation of the Lipman emulsion comprising microparticulate silver halide having an average particle diameter of $0.1\mu$ or less.

The silver halide particles may be shaped in any of cubic bodies, octahedral bodies, tetradecahedral bodies by the co-presence of them or various twin crystals or mixtures thereof. Further, the emulsion may comprise either coarse particles or minute particles.

The emulsion to be used in this invention may be doped with platinum, palladium, iridium, rhodium, ruthenium, bismuth, cadmium or copper, during or after formation of particles.

Further, the emulsion according to this invention may be subjected to elimination of unnecessary soluble salts after formation of particles, or they may be contained as such. When said salts are to be removed, there may be employed any of the methods which have been known for a long time in the art, such as Noodel water washing method or the dialyzing method, the flocculating water washing method, etc.

Further, the emulsion according to this invention can be sensitized by chemical sensitization. More specifically, chemical sensitization may be possible by the use of sulfur sensitizers such as allylthiocarbamide, thiourea, N,N-diphenylthiourea, sodium thiosulfate, cystine, etc.; active or inactive selenium sensitizers such as tetramethylselenourea, etc. and reducing sensitizers such as hydrogen gas, stannous salts, polyamines, etc.; noble metal sensitizers as exemplified by gold sensitizers, including potassium aurithiocyanate, potassium chloroaurate, 2-aurosulfobenzthiazolemethyl chloride, etc., sensitizers of water-soluble salts of ruthenium, rhodium, iridium, etc., including ammonium chloropalladate, potassium chloroplatinate and sodium chloropalladide, which may suitably be used alone or in combination.

Each of the green-sensitive emulsion containing a magenta coupler and the red-sensitive emulsion containing a cyan coupler according to this invention is optically sensitized by addition of an appropriate sensitizing dye in an amount of $5\times10^{-6}$ to $3\times10^{-3}$ mole per mole of silver halide, for the purpose of imparting light-sensitivity to the respective desired wavelength region. As the sensitizing dye, there may be employed various dyes, and either one kind or a combination of two or more kinds may be available for each emulsion. The sensitizing dyes to be advantageously used in this invention are exemplified below.

That is, as the sensitizing dye to be used in the green-sensitive emulsion, there may be included cyanine dyes, melocyanine dyes or complex cyanine dyes as typical examples, as disclosed in U.S. Pat. Nos. 1,939,201, 2,072,908, 2,739,149 and 2,945,763; and U.K. Pat. No. 505,979. On the other hand, as the sensitizing dye to be used in the red-sensitive emulsion, there may be included cyanine dyes, melocyanine dyes or complex cyanine dyes as typical examples, as disclosed in U.S. Pat. Nos. 2,269,234, 2,270,378, 2,442,710, 2,454,629 and 2,776,280. Further, it is possible to use advantageously cyanine dyes, melocyanine dyes or complex cyanine dyes as disclosed in U.S. Pat. Nos. 2,213,995, 2,493,748 and 2,519,001; and West German Pat. No. 929,080 for the green-sensitive emulsion or the red-sensitive emulsion.

The sensitive material of this invention can also contain other various known additives for photography incorporated therein. For example, there may be employed anti-foggants, stabilizers, UV-ray absorbers, color image fading preventives, color contamination preventives, fluorescent brighteners, anti-static agents, film hardeners, surfactants, plasticizers, wetting agents, as disclosed in, for example, Research Disclosure No. 17643.

The hydrophilic colloid to be used for preparation of the emulsion in the sensitive material of this invention may be inclusive of any of gelatin, derivatives of gelatin, graft polymers of gelatin with other polymers; proteins such as albumin and casein; cellulose derivatives such as hydroxyethyl cellulose derivatives, carboxymethyl cellulose, etc.; starch derivatives; synthetic hydrophilic homo- or co-polymers such as polyvinyl alcohol, polyvinyl imidazole, polyacrylamide, etc.

The sensitive material of this invention can be produced by providing by coating the emulsion layer according to this invention having incorporated, if desired, various additives for photography as described above together with other constituent layers directly or through intermediary subbing layer and intermediate layer on a support applied with corona discharging treatment, flame treatment or UV-ray irradiation treatment. As the support to be advantageously employed, there are, for example, baryta paper, polyethylene coated paper, polypropylene synthetic paper, transparent support having provided reflective layer in combination or using a reflective material in combination, such as glass plate, cellulose acetate, cellulose nitrate, polyester films such as polyethyleneterephthalate, etc., polyamide films, polycarbonate films, polystyrene films and others. These supports may be chosen suitably depending on the purpose of the use of the respective sensitive materials.

For providing by coating of the emulsion layer and other constituent layers to be used in this invention, there may be employed various coating methods such as the dipping coating, the air doctor coating, the curtain coating, the hopper coating, etc. It is also possible to employ the simultaneous coating of two or more layers according to the methods as disclosed in U.S. Pat. Nos. 2,761,791 and 2,941,898.

The red-sensitive emulsion layer containing a cyan coupler according to this invention is generally provided on a reflective support.

And, said emulsion layer is laminated generally together with known other green-sensitive and blue-sensitive emulsion layer according to a known method to constitute the sensitive material.

In this invention, the positions for respective emulsion layers may be determined as desired. For example, in case of a sensitive material for print of full color, it is preferable to arrange sequentially from the support side a blue-sensitive emulsion layer, a green-sensitive emulsion layer and a red-sensitive emulsion layer.

Also, in the sensitive material of this invention, an intermediate layer with an appropriate thickness may optionally be provided depending on the purpose, and further various layers such as filter layer, curl preventive layer, protective layer, anti-halation layer, etc. may also be used in a suitable combination as constituent layers. In these constituent layers, there may similarly be used as a binder the hydrophilic colloid which can be used for the emulsion as described above, and also similarly incorporated various additives for photography which can be contained in the emulsion layer as described above.

The sensitive material of this invention can be utilized for various uses and exhibit excellent characteristics depending on the respective purposes, including posi sensitive materials for general purposes, direct posi sensitive materials, sensitive materials for special purposes (e.g. for printing, X-ray or high resolution), particularly suitably as sensitive materials for color print papers.

The sensitive material of this invention, after exposure to light, can advantageously be color developed according to the color developing method to be used for conventional inner type color sensitive materials containing couplers. If image formation is effected according to the reversal process, development is performed first with a monochromatic nega developer and then the developed image is exposed to white light or treated with a bath containing a fogging agent, followed further by color developing with an alkali developer containing a color developing agent. After color development, bleaching treatment is applied with a bleaching liquor containing as an oxidizing agent ferricyanide, a metal complex salt such as of aminopolycarboxylic acid (e.g. ferric salts of ethylenediaminetetraacetic acid, nitrilotriacetic acid, N-hydroxyethyl ethylenediaminediacetic acid, etc.) or malonic acid, tartaric acid, malic acid, diglycolic acid, etc., followed further by the fixing treatment with a fixing liquor containing a solvent for silver salt such as thiosulfate, whereby the dye images remain with removal of the silver images and residual silver halide. In place of using a bleaching liquor and a fixing liquor, it is also possible to effect bleach-fixing by use of a one bath bleach-fixing liquor containing an oxidizing agent such as ferric salt of an aminopolycarboxylic acid and a solvent for silver sulfate such as thiosulfate. Also, respective treatments of water washing, stopping, stabilization, etc. may be applied in combination with color developing, bleaching, fixing or bleach-fixing.

The sensitive material of this invention is usually exposed through a sensitive material for photography and then developed with a color developer. A suitable color developing agent comprises an aromatic primary amine type color developing agent as the main component. Examples of the color developing agent are typically p-phenylenediamine type, including N,N-dimethyl-p-phenylenediamine, N,N-diethyl-p-phenylenediamine, N-carbamidomethyl-N-methyl-p-phenylenediamine, N-carbamido-methyl-N-tetrahydrofurfuryl-2-methyl-p-phenylenediamine, N-ethyl-N-carboxymethyl-2-methyl-p-phenylenediamine, N-carbamidomethyl-N-ethyl-2-methyl-p-phenylenediamine, N-ethyl-N-tetrahydrofurfuryl-2-methyl-p-aminophenol, 3-acetylamino-4-aminodimethylaniline, N-ethyl-N-β-methanesulfonamidoethyl-4-aminoaniline, N-ethyl-N-β-methanesulfonamidoethyl-3-methyl-4-aminoaniline, sodium salt of N-methyl-N-β-sulfoethyl-p-phenylenediamine, diethyl-p-phenylenediamine hydrochloride, monomethyl-p-phenylenediamine hydrochloride, dimethyl-p-phenylenediamine hydrochloride, 2-amino-5-diethylaminotoluene hydrochloride, 2-amino-5-(N-ethyl-N-dodecylamino)toluene, 2-amino-5-(N-ethyl-N-β-methanesulfonamidoethyl)aminotoluene sulfate, 4-(N-ethyl-N-β-methanesulfonamidoethylamino)aniline, 4-(N-ethyl-N-β-hydroxyethylamino)aniline, 2-amino-5-(N-ethyl-N-β-methoxyethyl)aminotoluene and the like.

And, these color developing agents may be used singly or as a combination of two or more kinds, or in combination with other monochromatic developing agents such as hydroquinone, etc. Further, color developers generally contain alkali agents such as sodium hydroxide, ammonium hydroxide, sodium carbonate, sodium sulfate, sodium sulfite, etc., and may further contain various additives, including alkali metal halides such as potasium bromide or developing controllers such as citrazinic acid, etc.

Subsequently, various known treatments may be applied to obtain color photographic images.

The sensitive material of this invention contains these color developing agents in the form of color developing agents or precursors thereof in the hydrophilic colloidal layer and can be treated with an alkaline activating bath.

A color developing precursor is a compound capable of forming a color developing agent under alkaline conditions, it may be added as a solution in an appropriate solvent such as water, methanol, ethanol, acetone, etc. or as an emulsified dispersion using a high boiling organic solvent such as dibutyl phthalate, dioctyl phthalate, tricresyl phosphate, etc., or it may also be impregnated into a latex before addition, as disclosed in Research Disclosure No. 14830.

According to this invention, there can be obtained cyan dye images with the maximum absorption wavelength of 640 to 660 nm, and very good cyan dye images with absorptions at 500 to 550 nm being very small.

The dyes formed are also very fast to heat, light and humidity.

Further, color forming characteristic is also very good. In addition, even when the bleaching bath or bleachfixing bath may be fatigued after running, the loss of dye is very small.

This invention is described in detail by referring to the following Examples, but the embodiments of this invention are not limited thereto.

EXAMPLE 1

By the use of the couplers of this invention and Control couplers as shown in the following Table 1, 10 g of each coupler was added to 5 ml of dibutyl phthalate and 30 ml of ethyl acetate and completely dissolved therein by heating to 60° C. The resultant solution was mixed with 5 ml of an aqueous 10% solution of Alkanol B (alkylnaphthalene sulfonate, produced by Du Pont de Nemours & Co.) and 200 ml of an aqueous 5% gelatin solution, followed by emulsification by the use of a colloid mill to prepare a dispersion of each coupler. Then, the coupler dispersion was added to 500 g of a gelatin-silver chlorobromide emulsion (containing 20 mole % of silver bromide), and the mixture was coated on a polyethylene coated paper and dried. Thus, six kinds of light-sensitive silver halide color photographic materials were prepared. These samples were subjected to wedge exposure according to a conventional method and thereafter the following treatments were applied.

Color developing treatment steps:

| | | |
|---|---|---|
| Color developing | 30° C. | 3 min. 30 sec. |
| Bleach-fixing | 30° C. | 1 min. 30 sec. |
| Washing with water | 30° C. | 2 min. |

Respective treating solutions in the color developing treatment steps had the compositions as shown below:

Composition of color developer:

| | |
|---|---|
| 4-Amino-3-methyl-N—ethyl-N—(β-methanesulfonamidoethyl)aniline sulfate | 5 g |
| Benzyl alcohol | 15 ml |
| Sodium hexametaphosphate | 2.5 g |
| Anhydrous sodium sulfite | 1.85 g |
| Sodium bromide | 1.4 g |
| Potassium bromide | 0.5 g |
| Borax | 39.1 g |

made up to one liter with addition of water and adjusted to pH 10.3 with sodium hydroxide.

Composition of bleach-fixing liquor:

| | |
|---|---|
| Ethylenediaminetetraacetic acid iron ammonium salt | 61.0 g |
| Ethylenediaminetetraacetic acid diammonium salt | 5.0 g |
| Sodium thiosulfate | 124.5 g |
| Sodium metabisulfate | 13.5 g |
| Anhydrous sodium sulfite | 2.7 g |

made up to one liter with addition of water.

For each of the samples obtained after the treatment, photographic characteristics were measured.

The results are shown in Table 1.

The sensitivity values in the Table are represented in terms of the relative sensitivites to that of Sample No. 1 as 100.

These measurements were conducted by means of PDA-60 Model densitometer (produced by Konishiroky Photo Industry Co.).

The symbol "D($\lambda_{550}$)" in the Table shows an evaluation of the tailing on the shorter wavelength side of the reflection spectrum of the cyan coupler after color formation, represenging the reflection density at 550 nm when the density of the maximum reflection spectrum after cyan color formation is 1.6. This indicates an influence of the green portion of the cyan coupler after color formation on the color reproducibility, and since the visual sensitivity of man is particularly high in this region, a slight change of this value "D($\lambda_{550}$)" will give an impression of a great change in tone to human eyes, and this value is preferably as small as possible from standpoint of photographic performance with respect to color production at the green portion.

TABLE 1

| Sample No. | Cyan coupler | Sensitivity | Maximum density | Reflected maximum wavelength | D($\lambda_{550}$) |
|---|---|---|---|---|---|
| 1 | Exemplary cyan coupler [I-2] | 100 | 2.30 | 657 (nm) | 0.82 |
| 2 | Exemplary cyan coupler [I-4] | 105 | 2.35 | 655 (nm) | 0.80 |
| 3 | Exemplary cyan coupler [I-5] | 100 | 2.28 | 655 (nm) | 0.85 |
| 4 | Control cyan coupler (A) | 85 | 1.95 | 655 (nm) | 0.93 |
| 5 | Control cyan coupler (B) | 95 | 2.00 | 652 (nm) | 0.95 |
| 6 | Control cyan coupler (C) | 100 | 2.10 | 640 (nm) | 1.10 |

Control cyan coupler (A):

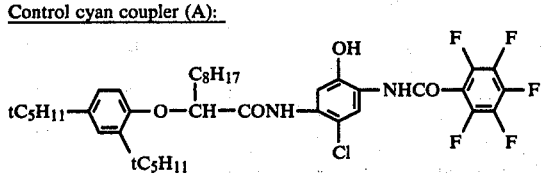

(Compound disclosed in U.S. Pat. No. 3,758,308)

Control cyan coupler (B):

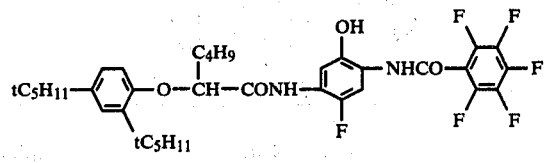

Control cyan coupler (C):

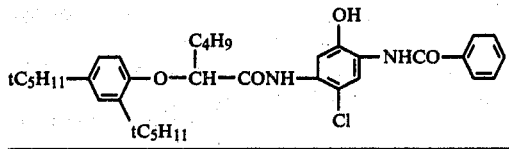

As apparently seen from Table 1, the cyan couplers according to this invention have spectral reflection characteristics [reflected maximum wavelength and $D(\lambda_{550})$] preferable in photographic performance, is improved markedly in visual sensitivity of man at the green sensitive portion, thus exhibiting photographic performances by far superior to those of the prior art technique.

Further, when compared with any of Control cyan couplers, they exhibit greater color forming densities and can be appreciated as cyan couplers having very good photograhic characteristics.

EXAMPLE 2

By the use of the cyan couplers of this invention and Control couplers as shown in Table 2, samples 7 to 12 having formed six kinds of cyan dye images were obtained similarly as in Example 1.

And, light resistance, heat resistance and humidity resistance were examined.

The results obtained are shown in Table 2.

Light resistance was shown after exposure of each image to a xenon fade-meter for 200 hours, heat resistance after two weeks at 77° C., and humidity resistance after two weeks at 60° C. under relative humidity of 70%, each being in terms of the residual density relative to the initial density of 1.0 (each residual percentage).

Stain was represented in terms of the percentage of the increased degree of the blue density at the unirradiated portion of the sample subjected to light resistance test.

TABLE 2

| Sample No. | Cyan coupler | Light resistance (%) | Heat resistance (%) | Humidity resistance (%) | Stain (%) |
|---|---|---|---|---|---|
| 7 | Exemplary cyan coupler [I-2] | 93 | 95 | 97 | 255 |
| 8 | Exemplary cyan coupler [I-4] | 95 | 98 | 97 | 220 |
| 9 | Exemplary cyan coupler [I-10] | 92 | 93 | 96 | 230 |
| 10 | Control cyan coupler (B) | 86 | 83 | 84 | 520 |
| 11 | Control cyan coupler (C) | 40 | 85 | 86 | 435 |
| 12 | Control cyan coupler (D) | 91 | 65 | 72 | 270 |

Control cyan coupler (D):

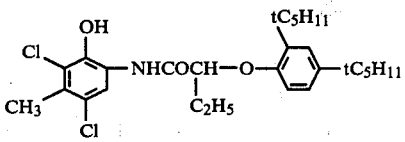

As apparently seen from Table 2, the Control coupler (D) is markedly poor in heat resistance and humidity resistance, while the Control cyan coupler (C) markedly poor in light resistance. Also, the Control cyan coupler (B) which exhibited relatively good results in Example 1 is markedly deteriorated in stain and inferior in light resistance, heat resistance and humidity resistance, as compared with the cyan couplers of this invention.

The cyan couplers according to this invention can be appreciated to have very excellent performance also in these respects.

EXAMPLE 3

By the use of the couplers of this invention and Control couplers as shown in the following Table 3, 10 g of each coupler was added to 5 ml of dibutyl phthalate and 30 ml of ethyl acetate and completely dissolved therein by heating to 60° C. as similarly in Example 1. The resultant solution was mixed with 5 ml of an aqueous 10% solution of Alkanol B (alkylnaphthalene sulfonate, produced by Du Pont de Nemours & Co.) and 200 ml of an aqueous 5% gelatin solution, followed by emulsification by the use of a colloid mill to prepare a dispersion of each coupler. Then, the coupler dispersion was added to 500 g of a gelatin-silver chlorobromide emulsion (containing 20 mole % of silver bromide), and the mixture was coated on a polyethylene coated paper and dried. Thus, six kinds of light-sensitive silver halide color photographic materials were prepared. These samples were subjected to wedge exposure according to a conventional method and thereafter treated similarly as in Example 1.

For each of the samples obtained after the treatment, photographic characteristics were measured.

The measurements were conducted by means of PDA-60 Model densitometer (produced by Konishiroku Photo Industry Co.). The results are shown in Table 3. The sensitivity values in the Table are represented in terms of the relative sensitivities to that of Sample No. 13 as 100.

TABLE 3

| Sample No. | Cyan coupler | Sensitivity | Maximum density | Reflected maximum wavelength (nm) |
|---|---|---|---|---|
| 13 | Exemplary cyan coupler [II-1] | 100 | 2.40 | 656 |
| 14 | Exemplary cyan coupler [II-2] | 98 | 2.35 | 657 |
| 15 | Exemplary cyan coupler [II-4] | 96 | 2.28 | 655 |
| 16 | Control cyan coupler (A) | 75 | 1.75 | 655 |
| 17 | Control cyan coupler (E) | 81 | 1.81 | 641 |
| 18 | Control cyan coupler (F) | 80 | 2.05 | 652 |

Control cyan coupler (E):

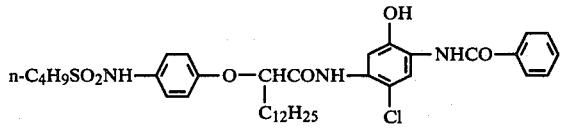

(Compound disclosed in Japanese Provisional Patent Publication No. 109630/1978)

Control cyan coupler (F):

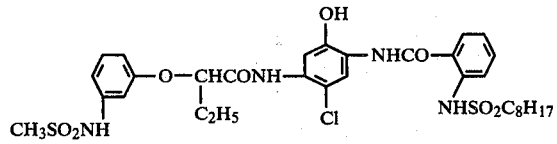

(Compound disclosed in Japanese Provisional Patent Publication No. 80045/1981)

As apparently seen from Table 3, the samples containing the cyan coupler of this invention have preferable spectral reflection characteristics and also exhibit color forming characteristics excellent in photographic performance, having greater color forming density and sensitivity than any of Control cyan couplers.

EXAMPLE 4

For samples having formed cyan dye images similarly as in Example 1 by use of the cyan couplers of this invention and Control cyan couplers as shown in Table 4, light resistance, heat resistance, humidity resistance and stain were examined. The results obtained are shown in Table 4.

TABLE 4

| Sample No. | Cyan coupler | Light resistance (%) | Heat resistance (%) | Humidity resistance (%) | Stain (%) |
|---|---|---|---|---|---|
| 19 | Exemplary cyan coupler [II-1] | 92 | 98 | 98 | 210 |
| 20 | Exemplary cyan coupler [II-2] | 95 | 96 | 97 | 250 |
| 21 | Exemplary cyan coupler [II-4] | 93 | 97 | 97 | 225 |
| 22 | Control cyan coupler (E) | 63 | 81 | 82 | 380 |
| 23 | Control cyan coupler (F) | 25 | 82 | 80 | 610 |
| 24 | Control cyan coupler (G) | 21 | 83 | 86 | 280 |
| 25 | Control cyan coupler (H) | 86 | 83 | 84 | 520 |

Control cyan coupler (G):

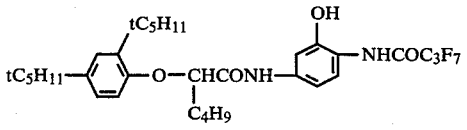

(Compound disclosed in U.S. Pat. No. 2,895,826)

Control cyan coupler (H):

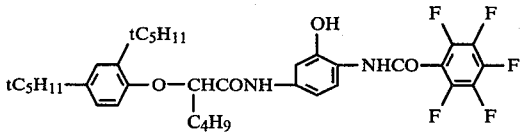

(Compound disclosed in U.S. Pat. No. 3,758,308)

In the above Table, light resistance and stain were measured similarly as in Example 2.

As apparently seen from Table 4, the Control coupler (F) and (G) are markedly poor in light resistance, although not so bad in heat resistance and humidity resistance, while the Control cyan coupler (H) is considerably greater in stain, although exhibiting relatively better results with respect to light resistance, heat resistance and humidity resistance as compared with other Control cyan couplers.

In contrast, the cyan couplers according to this invention can be appreciated to have very excellent performance also in all respects.

EXAMPLE 5

On a polyethylene resin-treated paper support which had been subjected to corona discharging treatment, the respective layers having the compositions shown below were sequentially coated from the support side to prepare three kinds of samples (Sample Nos. 26–28).

Layer 1 . . . Green-sensitive silver chlorobromide emulsion layer, containing a magenta coupler of Exemplary coupler [III-1], [III-7] or [III-9] dissolved and then dispersed in di-n-butyl phthalate (coated to an amount of magenta coupler of $1.2\times10^{-3}$ mole/m$^2$, a silver amount of 0.5 g/m$^2$ and a gelatin amount of 1.8 g/m$^2$).

Layer 2 . . . Intermediate layer comprising gelatin (0.5 g/m$^2$).

Layer 3 . . . Red-sensitive silver chlorobromide emulsion layer, containing a cyan coupler of Exemplary coupler [I-4], [II-2] or [II-1] dissolved and then dispersed in tricresyl phosphate (coated to an amount of cyan coupler of $1.7\times10^{-3}$ mole/m$^2$, a silver amount of 0.5 g/m$^2$ and a gelatin amount of 1.7 g/m$^2$).

Layer 4 . . . Protective layer comprising gelatin (0.5 g/m$^2$).

The combinations of magenta couplers and cyan couplers used for preparation of the above Samples 26 to 28 are as shown in Table 5.

Also, as Control examples in addition to Samples 26 to 28, the magenta coupler having the structure as shown below and cyan couplers were combined as shown in Table 5 to provide Samples Nos. 29 to 31.

TABLE 5

(Magenta coupler A for Control)

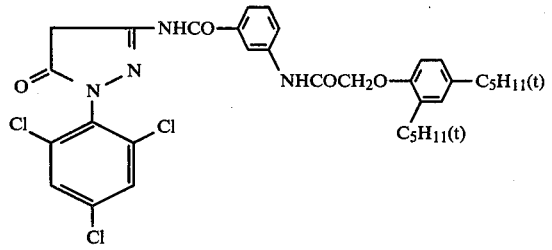

| Sample No. | Magenta coupler used for Layer 1 | Cyan coupler used for Layer 3 |
|---|---|---|
| Sample 26 (This invention) | Exemplary magenta coupler [III-1] | Exemplary cyan coupler [I-4] |
| Sample 27 (This invention) | Exemplary magenta coupler [III-7] | Exemplary cyan coupler [II-2] |
| Sample 28 (This invention) | Exemplary magenta coupler [III-9] | Exemplary cyan coupler [II-1] |
| Sample 29 (Control) | Magenta coupler A for Control | Exemplary cyan coupler [I-4] |
| Sample 30 (Control) | Exemplary magenta coupler [III-1] | Cyan coupler (D) for Control |
| Sample 31 (Control) | Exemplary magenta coupler [III-1] | Cyan coupler (E) for Control |

The thus obtained six kinds of Samples 26 to 31 were subjected to white light exposure through a light wedge by means of a sensitometer (Model KS-7, produced by Konishiroku Photo Industry Co.), followed by the color developing treatment according to the treatment steps shown below.

| Treatment step (33° C.) | Treatment time |
|---|---|
| Color developing | 3 min. |
| Bleach-fixing | 1 min. |
| Washing with water | 10 min. |

-continued

| Treatment step (33° C.) | Treatment time |
|---|---|
| Drying (95° C. or lower) | |

In the above treatment steps, the treating liquors having the following compositions were employed.

| [Composition of color developing liquor] | |
|---|---|
| N—ethyl-β-methanesulfonamidoethyl-3-methyl-4-aminoaniline (3/2 sulfate) | 4.0 g |
| Hydroxylamine | 2.0 g |
| Potassium carbonate | 25.0 g |
| Sodium chloride | 0.1 g |
| Sodium bromide | 0.3 g |
| Anhydrous sodium sulfite | 2.0 g |
| Benzyl alcohol | 13 ml |

Made up to one liter with addition of water, and adjusted to pH 10.0.

| [Composition of bleach-fixing liquor] | |
|---|---|
| Ethylenediaminetetraacetic acid iron sodium salt | 60 g |
| Ammonium thiosulfate | 100 g |
| Sodium bisulfite | 10 g |
| Sodium metabisulfite | 3 g |

Made up to one liter with addition of water, and adjusted to pH 7.0.

For the respective Samples obtained according to the treatment as described above, the tests with respect to light resistance, heat resistance and humidity resistance were conducted.

Light resistance test . . . Sample was exposed in a xenon fade-meter for 150 hours;

Heat resistance test . . . Sample was stored under the condition of 77° C. for 2 weeks;

Humidity resistance test . . . Sample was stored under the conditions of 60° C., 80% for 2 weeks.

The test results obtained are shown in Table 6 below. The numerical values in Table 6 are relative values of the densities after the tests to the dye density before the tests as being 100. As to measurement of the dye densities, reflected densities were measured by an optical densitometer (Model PDA-60, produced by Konishiroku Photo Industry Co.), and color densities were measured with a green filter for the magenta color forming portion and with a red filter for the cyan color forming portion.

TABLE 6

| | Couplers used | | Magenta dye | | | Cyan dye | | |
|---|---|---|---|---|---|---|---|---|
| Sample No. | Layer 1 | Layer 3 | Light resistance | Heat resistance | Humidity resistance | Light resistance | Heat resistance | Humidity resistance |
| 26 | Exemplary magenta coupler [III-1] | Exemplary cyan coupler [I-4] | 75 | 92 | 100 | 94 | 100 | 95 |
| 27 | Exemplary magenta coupler [III-7] | Exemplary cyan coupler [II-2] | 76 | 95 | 97 | 93 | 96 | 93 |
| 28 | Exemplary magenta coupler [III-9] | Exemplary cyan coupler [II-1] | 74 | 91 | 95 | 91 | 97 | 98 |
| 29 | Magenta coupler for Control A | Exemplary cyan coupler [I-4] | 21 | 101 | 104 | 92 | 98 | 96 |
| 30 | Exemplary magenta coupler [III-1] | Cyan coupler for Control (D) | 49 | 90 | 95 | 92 | 53 | 85 |
| 31 | Exemplary magenta coupler [III-1] | Cyan coupler for Control (E) | 42 | 103 | 98 | 91 | 98 | 92 |

As apparently seen from the above Table 6, the Control sample 29 is markedly inferior in light resistance of the magenta dye, the Control sample 30 is inferior in both light resistance of the magenta dye and heat resistance of the cyan dye, and the Control sample 31 is inferior in light resistance of the magenta dye.

However, Samples 26, 27 and 28 by the use of the combinations of the magenta couplers and cyan couplers according to this invention are found to be excellent in storage characteristics (light resistance, heat resistance and humidity resistance) of the cyan dye, and further markedly improved with respect to light resistance of the magenta dye, as compared with the above Control samples.

Also, as can be appreciated from the above Table, the above effect according to this invention can be obtained for the first time with the specific combination of the cyan coupler and the magenta coupler according to this invention. For example, as shown in Control sample 29 in Table 6, wherein the cyan coupler is used in combination with the Control magenta coupler or in Congrol samples 30 and 31, wherein the Control cyan coupler is used in combination with the magenta coupler according to this invention, it has been made clear that no simultaneous improvement of storage chracteristics for the cyan dye and the magenta dye as in this invention can be expected from such combinations.

In addition, in Control samples 29, 30 and 31, yellowish brown stains were found to be generated considerably greatly at the unirradiated portions, while no appreciable generation of stain was observed in any of the samples according to this invention.

EXAMPLE 6

Samples 32 to 38 as shown in Table 7 below were prepared in the same manner as in Example 5, except that the Exemplary magenta couplers were changed to Examplary coupler [III-8] and the cyan couplers were changed to those of the following formula. The chemical structure and the substituent R of said cyan coupler are shown below.

TABLE 7

(Cyan coupler)

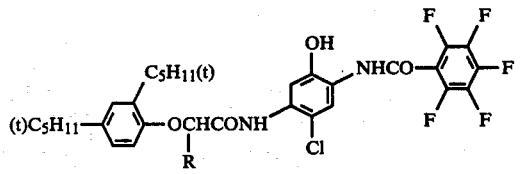

| Sample No. | Cyan coupler employed | Substituent R |
|---|---|---|
| 32 | Exemplary cyan coupler [I-6] | $-C_2H_5$ (n) |
| 33 | Exemplary cyan coupler [I-11] | $-C_3H_7$ (n) |
| 34 | Exemplary cyan coupler [I-4] | $-C_4H_9$ (n) |
| 35 | Exemplary cyan coupler [I-5] | $-C_6H_{13}$ (n) |
| 36 | Exemplary cyan coupler [I-12] | $-C_7H_{15}$ (n) |
| 37 | Cyan coupler (A) for Control | $-C_8H_{17}$ (n) |
| 38 | Cyan coupler (I) for Control | $-C_{10}H_{21}$ (n) |

The Samples 32–38 were subjected to the color developing treatments in entirely the same manner as in Example 5, and the storage characteristics for respective dyes were tested. These results of the tests are shown in Table 8.

TABLE 8

| | | Magenta dye | | | Cyan dye | | |
|---|---|---|---|---|---|---|---|
| Sample No. | Cyan couplers used | Light resistance | Heat resistance | Humidity resistance | Light resistance | Heat resistance | Humidity resistance |
| 32 | Exemplary cyan coupler [I-6] | 72 | 92 | 100 | 94 | 96 | 97 |
| 33 | Exemplary cyan coupler [I-11] | 76 | 95 | 101 | 93 | 97 | 98 |
| 34 | Exemplary cyan coupler [I-4] | 82 | 94 | 103 | 98 | 101 | 100 |
| 35 | Exemplary cyan coupler [I-5] | 72 | 93 | 99 | 96 | 100 | 94 |
| 36 | Exemplary cyan coupler [I-12] | 69 | 93 | 98 | 92 | 94 | 99 |
| 37 | Cyan coupler (A) for Control | 46 | 91 | 98 | 90 | 92 | 94 |
| 38 | Cyan coupler (I) for Control | 42 | 90 | 100 | 88 | 89 | 91 |

From the results shown in the above Table, it can be seen that the light resistance of the magenta dye by the magenta coupler used in combination with a cyan coupler is markedly improved, when the substituent R in the cyan coupler used is an alkyl group having carbon atoms of 7 or less.

We claim:

1. A light-sensitive silver halide color photographic material which comprises a light-sensitive silver halide emulsion layer containing at least one kind of cyan dye forming couplers represented by the formula [I] or the formula [II] as shown below provided on a reflective support:

Formula [I]

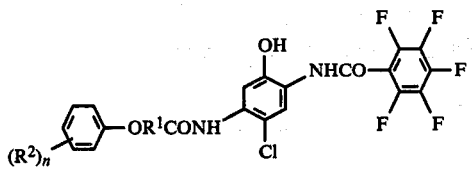

wherein $R^1$ represents a straight or branched alkylene group having 1 to 8 carbon atoms; $R^2$ represents an alkyl group; and n represents an integer of 1 to 3; $R^2$ may be the same or different when n is 2 or more, Formula [II]

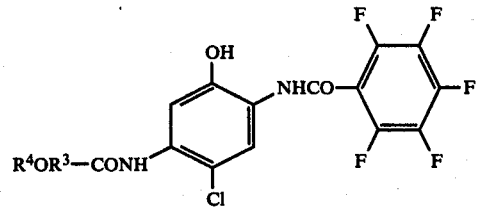

wherein $R^3$ represents a straight or branched alkylene group; and $R^4$ represents a phenyl group having an alkylsulfamoyl group, an arylsulfamoyl group, an alkylsulfonamide group, an arylsulfonamide group or an aminosulfonamide group.

2. A light-sensitive silver halide color photographic material according to claim 1, further having a green-sensitive silver halide emulsion layer containing at least one kind of magenta couplers represented by the formula [III] as shown below:

Formula [III]

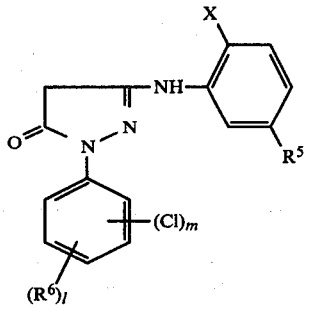

wherein $R^5$ represents a group

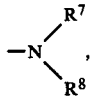

wherein $R^7$ and $R^8$ each represent a hydrogen atom, an alkyl group, an acyl group, an alkylsulfonyl group or an arylsulfonyl group, or $R^7$ and $R^8$ taken together may form a 5-membered heterocyclic ring together with nitrogen atom, a sulfamoyl group, a carbamoyl group, a ureido group or a carboxylic acid ester group; $R^6$ represents a methoxy group or a methyl group; X represents a halogen atom or an alkoxy group having 1 to 5 carbon atoms; l represents an integer of 0 to 2; and m represents an integer of 1 to 3.

3. A light-sensitive silver halide color photographic material according to claim 2, wherein said magenta coupler has the following formula [III']:

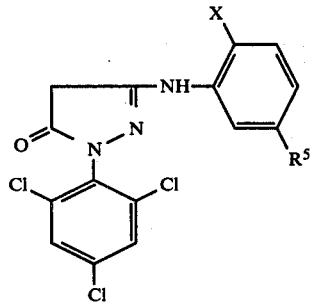

wherein $R^5$ and X have the same meanings as defined above.

4. A light-sensitive silver halide color photographic material according to claim 1, wherein the cyan dye forming coupler is contained in a red-sensitive silver halide emulsion layer.

5. A light-sensitive silver halide color photographic material according to claim 1, wherein $R^1$ in the formula [I] represents a branched alkylene group having 1 to 8 carbon atoms.

6. A light-sensitive silver halide color photographic material according to claim 5, wherein the carbon atoms of the alkylene group is 3 to 6.

7. A light-sensitive silver halide color photographic material according to claim 6, wherein said alkylene group is a 2-methyl-1,1-propylene group.

8. A light-sensitive silver halide color photographic material according to claim 1, wherein $R^2$ in the formula [I] represents an alkyl group having 4 to 6 carbon atoms.

9. A light-sensitive silver halide color photographic material according to claim 1, wherein n in the formula [I] is 2.

10. A light-sensitive silver halide color photographic material according to claim 2, wherein each $R^7$ and $R^8$ is a hydrogen atom or an acyl group.

11. A light-sensitive silver halide color photographic material according to claim 2, wherein X in the formula is a halogen atom.

12. A light-sensitive silver halide color photographic material according to claim 11, wherein said halogen atom is a chlorine atom.

13. A light-sensitive silver halide color photographic material according to claim 1, wherein said cyan coupler represented by the formula [I] and [II] is contained in an amount of 10 to 30 mole % per mole of the silver halide.

14. A light-sensitive silver halide color photographic material according to claim 2, wherein said magenta coupler represented by the formula [III] is contained in an amount of 10 to 30 mol % per mole of the silver halide.

15. A light-sensitive silver halide color photographic material according to claim 3, wherein said magenta coupler represented by the formula [III'] is contained in an amount of 10 to 30 mole % per mole of the silver halide.

16. A light-sensitive silver halide color photographic material according to claim 3, wherein each $R^7$ and $R^8$ is a hydrogen atom or an acyl group.

17. A light-sensitive silver halide color photographic material according to claim 3, wherein X in the formula is a halogen atom.

18. A light-sensitive silver halide color photographic material according to claim 17, wherein said halogen atom is a chlorine atom.

* * * * *